US006438765B1

(12) United States Patent
Johnson et al.

(10) Patent No.: US 6,438,765 B1
(45) **Date of Patent: *Aug. 27, 2002**

(54) TOILET SEALING RING ADAPTER ASSEMBLY

(76) Inventors: Michael W. Johnson; Gregory L. Sesser, both of 1025 Lone Palm Ave., #2J, Modesto, CA (US) 95351

( * ) Notice: Subject to any disclaimer, the term of this patent is extended or adjusted under 35 U.S.C. 154(b) by 0 days.

This patent is subject to a terminal disclaimer.

(21) Appl. No.: 09/878,590

(22) Filed: Jun. 11, 2001

Related U.S. Application Data

(63) Continuation of application No. 09/197,947, filed on Nov. 23, 1998, now Pat. No. 6,327,717, which is a continuation of application No. 08/948,765, filed on Oct. 10, 1997, now Pat. No. 5,862,533, which is a continuation of application No. 08/685,991, filed on Jul. 27, 1996, now abandoned, which is a continuation-in-part of application No. 08/517,368, filed on Aug. 21, 1995, now abandoned.

(51) Int. Cl.[7] ..... E03D 11/17

(52) U.S. Cl. ..... 4/252.4

(58) Field of Search ..... 4/252.4, 252.5, 4/252.6; 285/59, 60

(56) References Cited

U.S. PATENT DOCUMENTS

| | | | |
|---|---|---|---|
| 3,012,252 | A | 12/1961 | Gaddy |
| 3,501,172 | A | 3/1970 | Pickard |
| 3,846,851 | A | 11/1974 | Pepper |
| 4,406,480 | A | 9/1983 | Izzi |
| 4,482,161 | A | 11/1984 | Izzi, Sr. |
| 4,648,139 | A | 3/1987 | Stokes |
| 4,871,451 | A | 10/1989 | Piskula |
| 4,883,590 | A | 11/1989 | Papp |
| 4,918,761 | A | 4/1990 | Harbeke |
| 4,984,308 | A | 1/1991 | Handal |
| 5,185,890 | A | 2/1993 | Dismore et al. |
| 5,862,533 | A | 1/1999 | Johnson et al. |

*Primary Examiner*—Robert M. Fetsuga
(74) *Attorney, Agent, or Firm*—Gardere Wynne Sewell LLP

(57) ABSTRACT

A toilet sealing ring adapter assembly for use in association with a toilet and a sewer pipe, the toilet sealing ring adapter assembly comprising: a flexible seal formed in a generally cylindrical configuration with a central aperture including coupling devices, the flexible seal adapted to be mounted within a sewer pipe; and a toilet ring formed in a generally cylindrical configuration with a central aperture, the ring including an upper region and a lower region, the upper region including a planar ledge extending therefrom, the ledge including a plurality of apertures to permit coupling to a toilet and mounting surface with bolts, the lower region including coupling devices to permit secure coupling within the flexible seal.

6 Claims, 5 Drawing Sheets

TOILET SEALING RING ADAPTER ASSEMBLY

CROSS REFERENCE TO RELATED APPLICATION

This application is a continuation of co-pending U.S. patent application Ser. No. 09/197,947, filed Nov. 23, 1998, now U.S. Pat. No. 6,327,717, which is a continuation of application Ser. No. 08/948,765, filed Oct. 10, 1997, now U.S. Pat. No. 5,862,533 which is a continuation of application Ser. No. 08/685,991, filed Jul. 27, 1996, abandoned, which is a continuation-in-part of application Ser. No. 08/517,368, filed Aug. 21, 1995, abandoned.

BACKGROUND OF THE INVENTION

The use of toilet bowl mounting devices is known in the prior art. More specifically, toilet bowl mounting devices heretofore devised and utilized for the purpose of mounting toilets upon sewer pipes are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,185,890 to Dismore a toilet bowl sealing assembly.

U.S. Pat. No. 4,984,308 to Handal discloses a toilet sealing ring.

U.S. Pat. No. 4,883,590 to Papp discloses an adjustable floor drain apparatus.

U.S. Pat. No. 4,648,139 to Stokes discloses a mounting ring assembly for a toilet bowl.

U.S. Pat. No. 4,918,761 to Harbeke discloses a method of using a toilet-flange cast-in mount.

Lastly, U.S. Pat. No. 4,871,451 to Piskula discloses a floor drain plate assembly.

In this respect, the toilet sealing ring adapter assembly according to the present invention substantially departs from the conventional concepts and designs of the prior art, and in doing so provides an apparatus primarily developed for the purpose of coupling toilets within four inch sewer pipes.

Therefore, it can be appreciated that there exists a continuing need for a new and improved toilet sealing ring adapter assembly which can be used for coupling toilets within four inch sewer pipes. In this regard, the present invention substantially fulfills this need.

SUMMARY OF THE INVENTION

In view of the foregoing disadvantages inherent in the known types of toilet bowl mounting devices now present in the prior art, the present invention provides an improved toilet sealing ring adapter assembly. As such, the general purpose of the present invention, which will be described subsequently in greater detail, is to provide a new and improved toilet sealing ring adapter assembly and method which has all the advantages of the prior art and none of the disadvantages.

To attain this, the present invention essentially comprises a new and improved toilet sealing ring adapter assembly for use in association with a toilet, the toilet sealing ring adapter assembly comprising, in combination: a four inch sewer pipe, the sewer pipe having a horizontally oriented open mouth with an upper periphery; a rubber seal formed in a generally cylindrical configuration with a central aperture having a plurality of internal screw threads, the rubber seal having a smooth outer surface, an upper extent with a circumference and a lower extent, the seal adapted to be positioned within a four inch sewer pipe; and a toilet ring fabricated of cast iron and formed in a generally cylindrical configuration with a central aperture, the ring including an upper region and a lower region, the, upper region having a larger inner diameter than the lower region with a gradually decreasing diameter therebetween, the upper region including a planar circular shaped ledge extending therefrom, the ledge including an upper surface and a perimeter with diametrically opposing elongated closet bolt recesses formed contiguously with the perimeter, each recess including a closet bolt extending therethrough and above the ledge, the ledge also including diametrically opposing closet bolt apertures extending therethrough, the ledge further including four equidistantly spaced beveled holes extending therethrough, the lower region including a plurality of external screw threads, the lower region adapted to be threadedly coupled within the rubber seal, in an operative orientation the upper surface of the ledge supporting a toilet bowl with the closet bolts securing the toilet bowl in place.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet sealing ring adapter assembly which has all of the advantages of the prior art toilet bowl mounting devices and none of the disadvantages.

It is another object of the present invention to provide a new and improved toilet sealing ring adapter assembly which may be easily and efficiently manufactured and marketed.

It is further object of the present invention to provide a new and improved toilet sealing ring adapter assembly which is of durable and reliable constructions.

An even further object of the present invention is to provide a new and improved toilet sealing ring adapter assembly which is susceptible of a low cost of manufacture with regard to both materials and labor, and which accordingly is then susceptible of low prices of sale to the consuming public, thereby making such toilet sealing ring adapter assembly economically available to the buying public.

Still yet another object of the present invention is to provide a new and improved toilet sealing ring adapter assembly which provides in the apparatuses and methods of the prior art some of the advantages thereof, while simultaneously overcoming some of the disadvantages normally associated therewith.

Still another object of the present invention is to couple toilets within four inch sewer pipes.

Lastly, it is an object of the present invention to provide a new and improved a toilet sealing ring adapter assembly for use in association with a toilet and a sewer pipe, the toilet sealing ring adapter assembly comprising: a flexible seal formed in a generally cylindrical configuration with a central aperture including coupling devices, the flexible seal adapted to be mounted within a sewer pipe; and a toilet ring formed in a generally cylindrical configuration with a central aperture, the ring including an upper region and a lower region, the upper region including a planar ledge extending therefrom, the ledge including a plurality of apertures to permit coupling to a toilet and mounting surface with bolts, the lower region including coupling devices to permit secure coupling within the flexible seal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DETAILED DESCRIPTION OF THE PREFERRED EMBODIMENT

Figure 1:
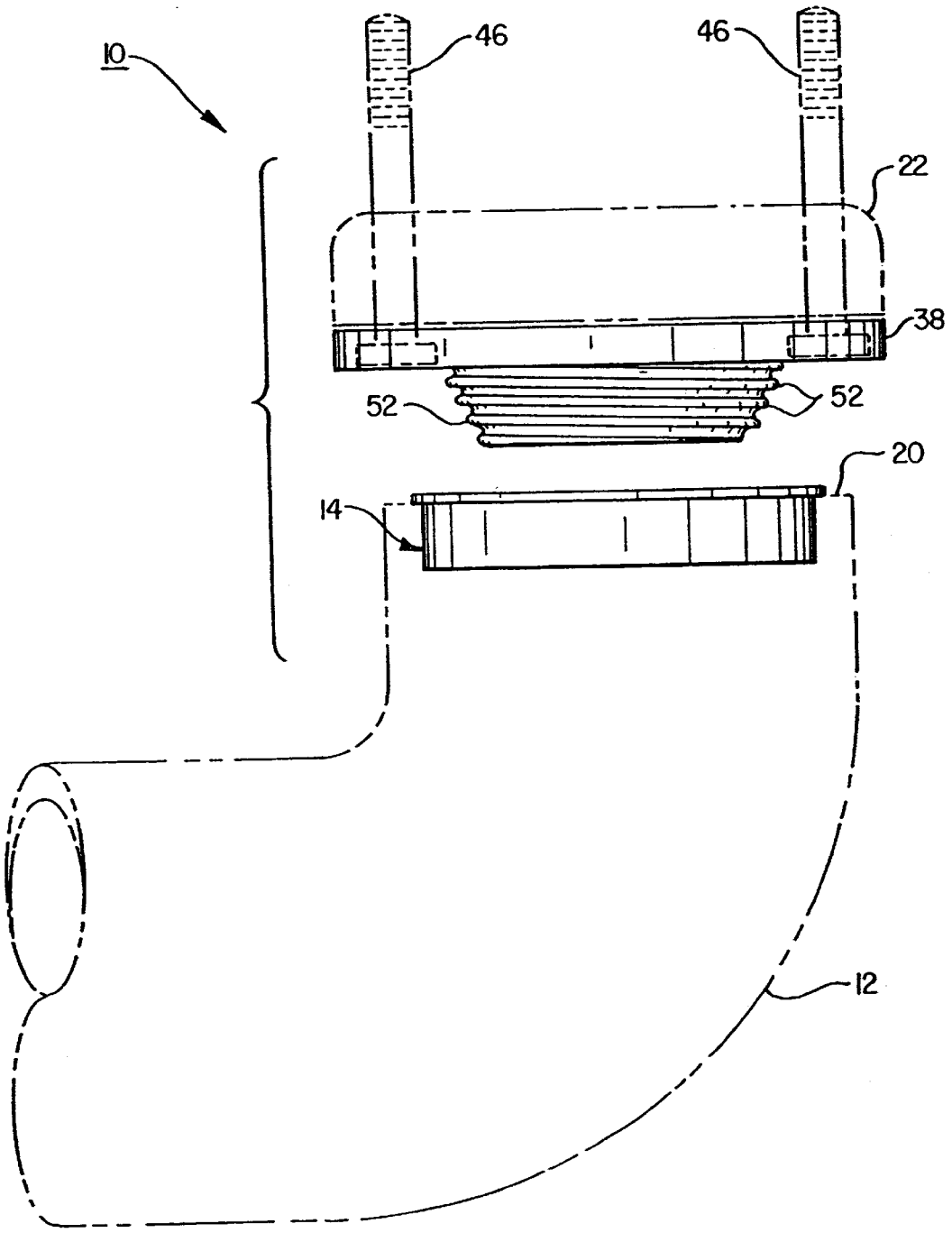
FIG. 1 is a side view of the preferred embodiment of the toilet sealing ring adapter assembly constructed in accordance with the principles of the present invention.

With reference now to the drawings, and in particular to FIG. 1 thereof, the preferred embodiment of the new and improved toilet sealing ring adapter assembly embodying the principles and concepts of the present invention and generally designated by the reference numeral 10 will be described.

The present invention, the toilet sealing ring adapter assembly 10 is comprised of a plurality of components. Such components in their broadest context include a sewer pipe 12, a rubber seal 14 and a toilet ring 16. Such components are individually configured and correlated with respect to each other so as to attain the desired objective.

More specifically, the toilet sealing ring adapter assembly 10 is adapted for use in association with a conventional toilet. The apparatus includes a sewer pipe 12. The sewer pipe is preferably of a four-inch diameter and is fabricated of any of the conventional materials for sewer pipes such as cast iron ABC, PVC, transit, lead, vitreous clay, etc. The pipe is fabricated in a plurality of different lengths and configurations to accommodate the requirements of different users. In the most instances, the pipe will be positioned beneath the floor of a bathroom, with the pipe extending upward from the floor. The sewer pipe has a horizontally oriented open mouth with an upper periphery 20. In the operative orientation, a toilet is coupled to the open mouth of the pipe by use of the toilet sealing ring adapter assembly 10 and a formable elastomeric ring 22. Note FIG. 1.

Figure 2:
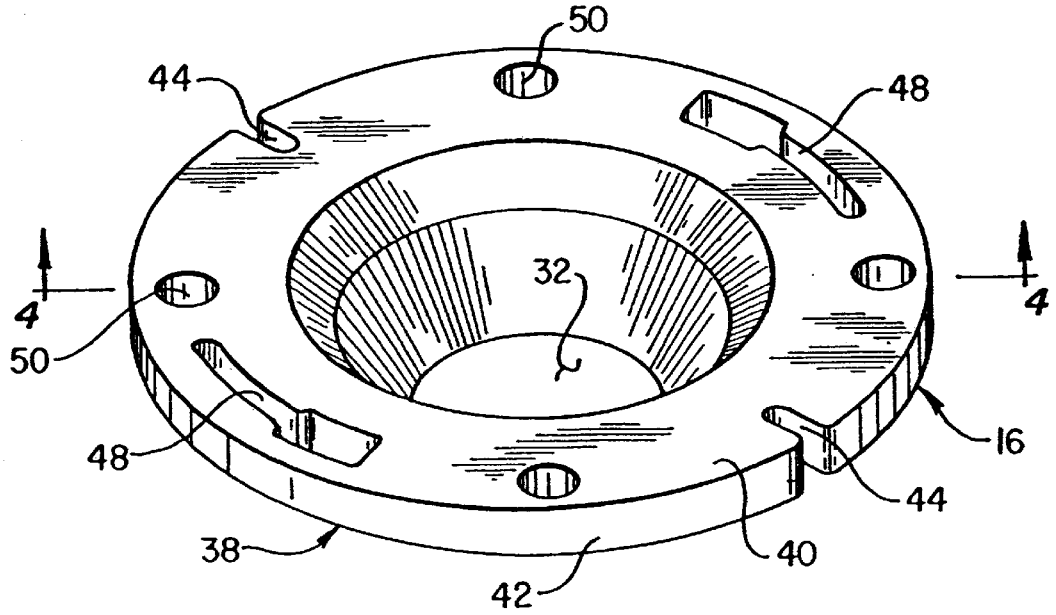
FIG. 2 is a side view of the toilet ring of the apparatus.
Figure 3:
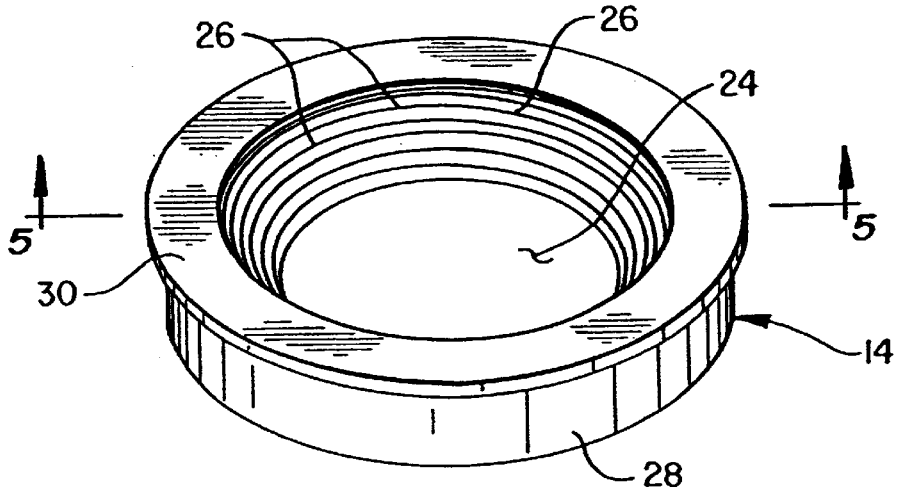
FIG. 3 is a perspective view of the rubber seal of the apparatus.
Figure 5:
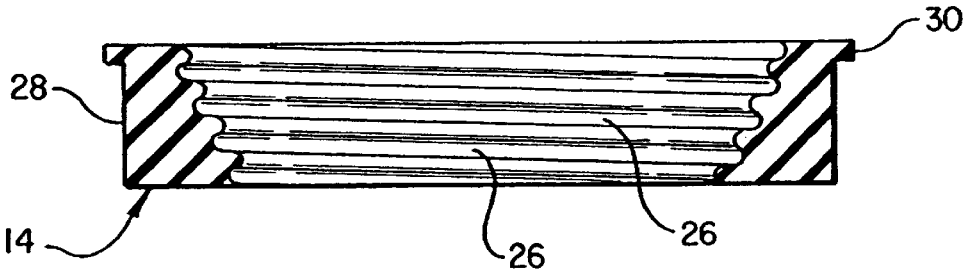
FIG. 5 is a cross-sectional view of the toilet ring taken along section line 5—5 of FIG. 3.

A rubber seal 14 is formed in a generally cylindrical configuration with a central aperture 24. The outer diameter of the seal is approximately four and one quarter inches. The diameter of the aperture of the seal is approximately three inches. The height of the rubber seal is approximately one and one eighth inches. The rubber seal also has a plurality of internal female screw threads 26. The rubber seal has a smooth outer surface 28. This feature allows the user to place the seal within a pipe even if the internal screw threads of the pipe have been worn. The upper extent of the seal has a circumference and the embodiment of FIGS. 1 and 5, includes a lip 30 projecting outwardly from it. The lip allows the rubber seal to sit flush on top of the sewer pipe without falling into the interior of the pipe. The lower extent of the seal is adapted to be positioned within a four-inch cast iron sewer pipe with the lip positioned flush with the upper periphery of the pipe. Note FIGS. 1–3.

A toilet ring 16 is fabricated of cast iron or other suitable material and formed in a generally cylindrical configuration with a central aperture 32. The height of the toilet ring is approximately one and one half inches. In alternative embodiments of the apparatus, the toilet ring is fabricated of ABS plastic or PVC materials. The ring includes an upper region 34 and a lower region 36. The upper region has a larger inner diameter than the lower region with a gradually decreasing diameter therebetween. The diameter of the lower region of the central aperture is approximately two and three quarters inches. In the preferred embodiment, the toilet ring is fabricated of cast iron. The preferred embodiment is utilized for industrial applications. In an alternative embodiment, the toilet ring is fabricated of ABS plastic. This embodiment is utilized for the retail and do-it-yourself markets. Note FIGS. 1, 3 and 5.

Figure 4:
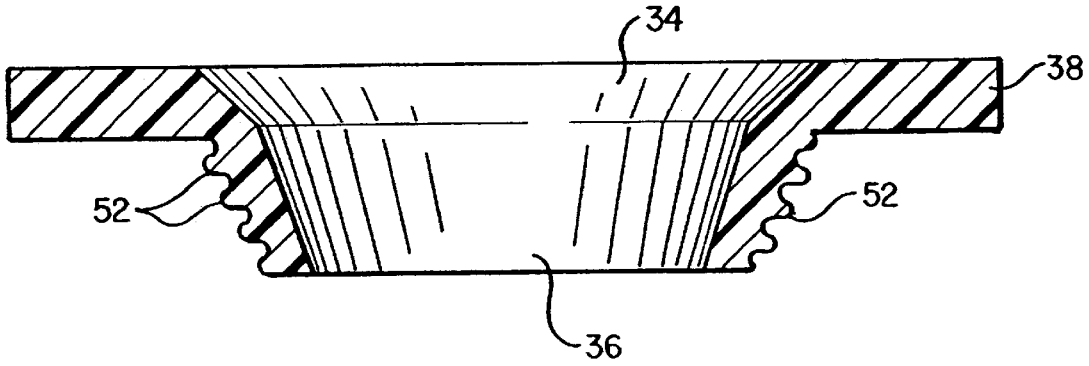
FIG. 4 is a cross-sectional view of the toilet ring taken along section line 4—4 of FIG. 2.

The upper region includes a planar circular shaped ledge 38 extending from it. The ledge includes an upper surface 40 and a perimeter 42. The diameter of the ledge is approximately six and fifteen sixteenths inches. In one embodiment of the apparatus, the ledge is fabricated of cast iron. In another embodiment of the apparatus, the ledge is fabricated of an elastomeric substance, such as plastic or rubber. The ring has diametrically opposing closet bolt recesses 44 formed contiguously with the perimeter. Each recess 44 includes a closet bolt 46 extending through it and above the ledge. The closet bolts are adapted to be threadedly coupled to a toilet. The ledge also includes diametrically opposing elongated closet bolt apertures 48 extending therethrough. The apertures 48 permit the positioning of additional closet bolts therethrough. Note FIGS. 1, 2 and 4.

The ledge further includes four equidistantly spaced beveled holes 50 extending therethrough. The bevel holes permit the secure coupling of the ring to the floor of a bathroom or other mounting surface. The present invention can reduce the installation time of a toilet. This is due to the fact that mounting the toilet sealing ring assembly 10 to the interior eliminates the need for time consuming floor sawing around the pipe. Note FIGS. 1, 2 and 4.

The lower region includes a plurality of male external screw threads 52. The lower region is adapted to be threadedly coupled within the rubber seal. In one embodiment of the apparatus, the male external screw threads are fabricated of cast iron. In another embodiment, the male external screw threads are fabricated of an elastomeric substance, such as plastic or rubber. In an operative orientation, the upper surface of the ledge supports a toilet bowl, and the closet bolts secure the toilet bowl in place. Note FIGS. 1 and 4.

Figure 6:
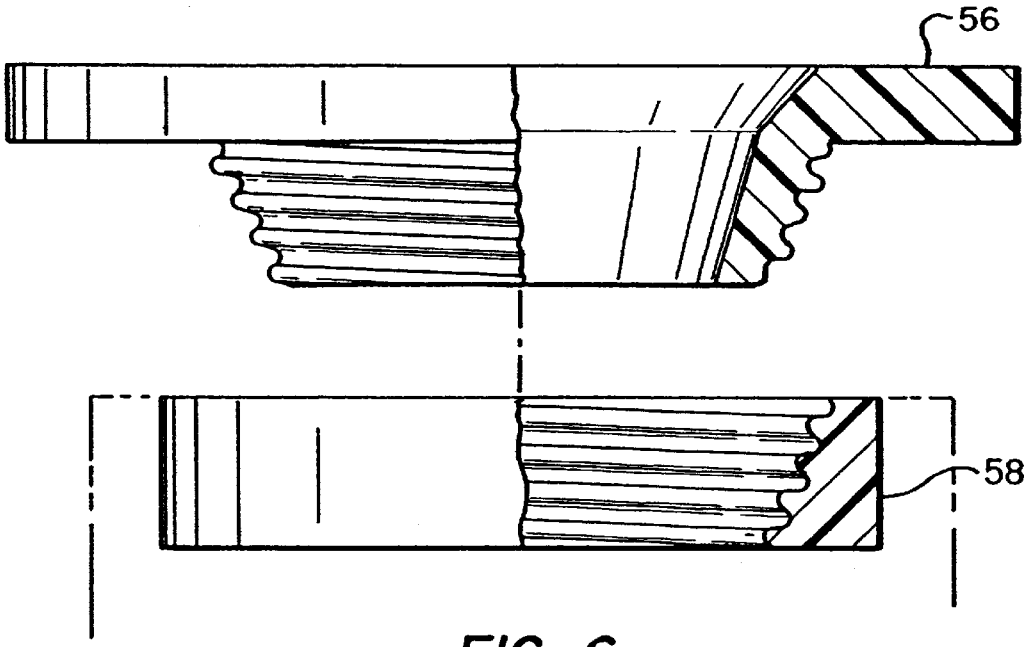
FIG. 6 is a cross sectional view similar to FIGS. 4 and 5 but illustrating an alternate embodiment of the invention.
Figure 7:
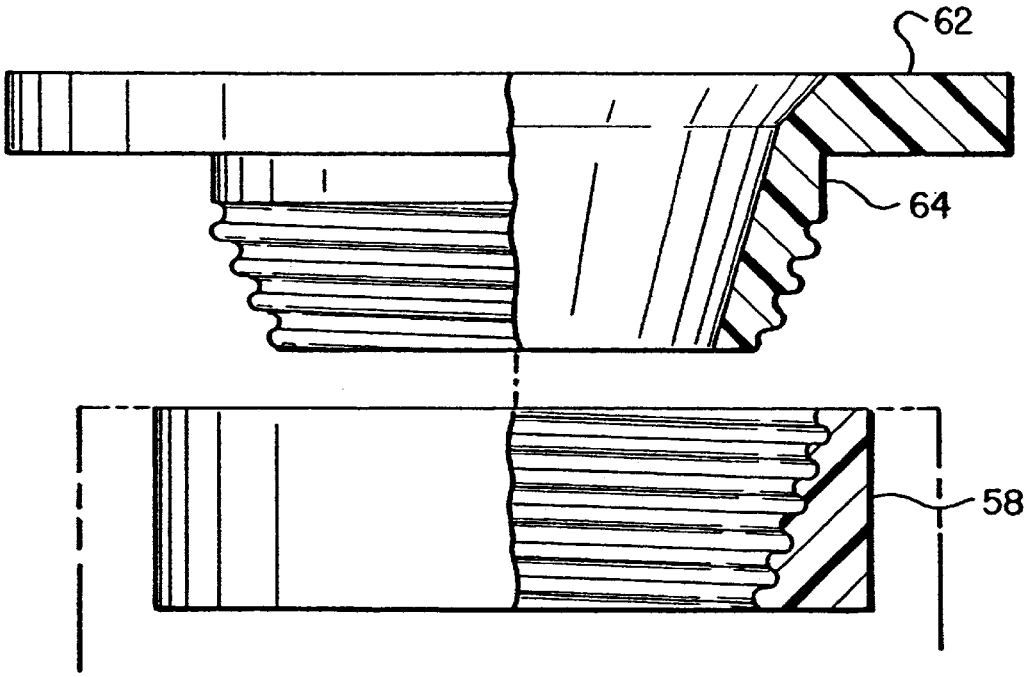
FIGS. 7 and 8 are a cross sectional view similar to FIG. 6, but illustrating two further alternate embodiment of the invention.
Figure 8:
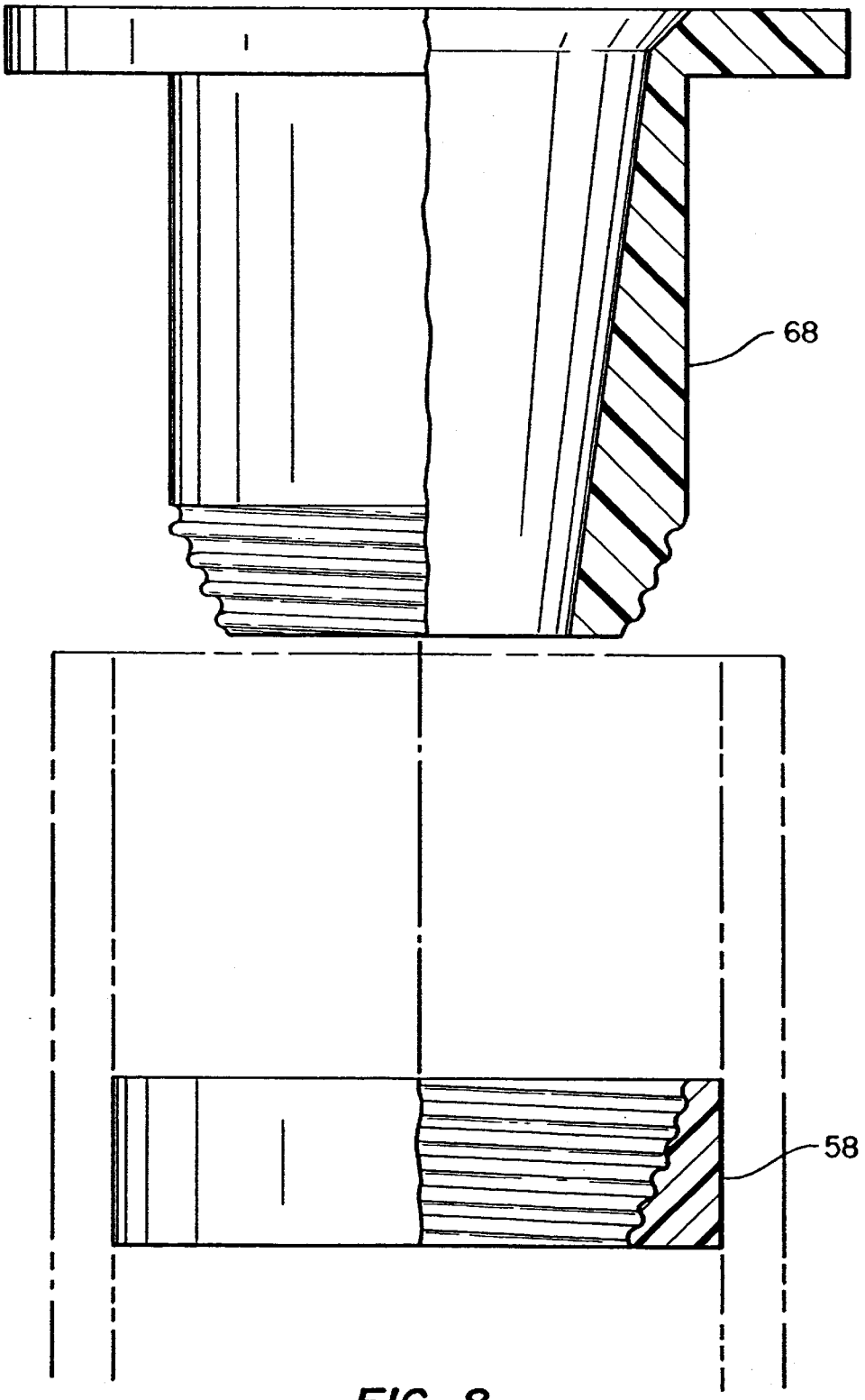

Alternate embodiments of the inventions are shown in FIGS. 6, 7 and 8. In the FIG. 6 embodiment, the seal is shown as being formed without the lip to maintain the seal at the upper edge of the sewer pipe. In such alternate embodiment, the lip is removed and the seal is located with its upper edge at the upper edge of the sewer pipe. In such alternate embodiment, there is no extender on the toilet ring as in the following embodiments of FIGS. 7 and 8. In the following embodiment as shown in FIG. 7, a cylindrical extender or spacer is formed between the ledge of the toilet ring and it threads. This allows for the coupling between the toilet ring and the flexible seal to be fully effective in the event that flooring or other material is on the floor surrounding and above the sewer pipe. In such FIG. 7 embodiment, the toilet is located as in the FIG. 6 embodiment but the ledge and toilet thereabove are at a slightly elevated location. In the FIG. 8 embodiment, the spacer or extender is of an extended length to allow for the positioning of the seal to a lower position within the sewer pipe and the toilet ring at a further elevated elevation.

More specifically, in light of the alternate embodiments, the present invention may also be considered as including a toilet sealing ring adapter assembly for use in association with a toilet and a sewer pipe. The toilet sealing ring adapter assembly thus comprises a flexible seal formed of a resilient material in a generally cylindrical configuration with a central aperture forming an upper region and a lower region and also forming an internal surface and an external surface, the external surface having a common diameter along its axial length and adapted to be positioned in contact with an interior surface of a sewer pipe, the interior surface being cone shaped in configuration with screw threads formed therein.

Also included as part of the assembly is a toilet ring formed of an essentially rigid material in a generally cylindrical configuration with a central aperture forming an upper region and a lower region and also forming an internal surface and external surface, the external surface being cone shaped in configuration with external screw threads formed thereon, the upper region including a planar ledge extending therefrom the ledge including a plurality of apertures to permit coupling to a toilet, the threads of the toilet ring being positionable within the threads of the seal whereby upon rotation of the ring with respect to the seal the toilet ring will be pulled into the seal and the seal will be expanded radially for securing the seal and toilet ring in a sewer pipe.

In the FIG. 6 embodiment, the toilet ring 56 is formed as in the primary embodiment. The seal 58 is formed in the primary embodiment except that the lip is removed whereby the upper edge of the seal is flush with the upper edge of the sewer pipe.

In the FIG. 7 embodiment, the toilet ring 62 further includes a cylindrical extender or spacer 64 formed in the toilet ring between the planar ledge and the threads. In such FIG. 7 embodiment, the axial length of the extender is between about ¼ inch and ¾ inch. The seal 58 is as in the prior embodiments. In the FIG. 8 embodiment, the extender or spacer 68 has an axial length of about 4 inches, plus or minus 10%. The ring is formed as in the prior embodiments but is preferably located beneath the upper edge of the sewer pipe. In both embodiments of FIGS. 7 and 8, there is thus provided, by the extender or spacer, a space above the upper edge of the sewer pipe for additional flooring material. The length of the extender may thus be between about 0.25 inches and 4.4 inches as a function of the particular application.

The seal is preferably formed from an essentially resilient material selected from the class of essentially resilient material including an elastomeric material, natural rubber or synthetic, including blends thereof.

The toilet ring is preferably formed of an essentially rigid material selected from the class of essentially rigid materials including cast iron, ABS and PVC.

The threads of the seal and toilet ring in all embodiments are such that a complete coupling between the threads is affected by between about 2.5 and 4.5 rotations of the ring with respect to the seal.

The method of installing the toilet sealing ring adapter assembly as set forth above is afforded, first, by providing the abovementioned components. The user may start installation by separating the seal and the ring by rotating the seal counterclockwise with respect to the ring. This is necessary since the present invention is delivered to a user in an engaged orientation. The next step is to insert the seal concentrically into the sewer pipe so that the upper extent is situated above the lower extent. It is also important that the seal is flush with the open mouth of the sewer pipe. The closet bolts are then installed within the designated recesses. After such, the lower region of the toilet ring is inserted into the seal until contact is made whereat the toilet ring is rotated in a clockwise direction with respect to the seal until the toilet ring is secured within the seal. The following step consists of pressing the toilet ring and seal combination downwardly until the toilet ring is flush with the floor.

It should be noted that the closet bolts are, more than likely, improperly located after tightening the toilet ring within the seal. The closet bolts would inevitably effect skewed installation of the toilet if utilized in such position. As such, additional steps are required to ensure proper placement of the toilet with respect to an adjacent wall. Firstly, the seal and a floor surrounding the sewer pipe and the seal must be marked with a radial line thereby noting the position of the seal with respect to the sewer pipe and the floor. Next an angle must be determined that a line which the closet bolts define is offset from being parallel with the adjacent wall. Upon such determination, the toilet ring is separated from the seal by rotating the toilet ring counterclockwise with respect to the seal after which the seal is removed from the sewer pipe. The seal is then ready to be inserted within the sewer pipe again so that the marking on the floor and the marking on the seal are offset by said angle. After this, steps may be repeated to reinstall the toilet ring and subsequently secure the toilet in a proper orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet sealing ring adapter assembly for use in forming a connection to a sewer pipe, said sewer pipe having a generally horizontally oriented open mouth at an upper periphery of said sewer pipe, said sealing ring adapter assembly comprising:

a rubber seal formed in a generally cylindrical configuration with a generally central passage having an interior surface that is cone shaped in configuration and is provided with a plurality of internal screw threads on said interior surface, said rubber seal having a generally cylindrical outer surface and being adapted to be positioned within said sewer pipe and resiliently deformable into engagement with an inner wall surface of said sewer pipe; and a toilet ring fabricated of one of metal and plastic in a generally cylindrical configuration and including a central aperture extending therethrough, said ring including an upper region and a lower region, said upper region including a generally circular ledge having an upper transverse generally planar surface, a plurality of elongated closet bolt receiving apertures formed in said ledge circumferentially spaced apart about said central aperture and a plurality of circumferentially spaced apart holes formed in said ledge, said lower region of said ring being formed to have a generally cone shaped portion including a plurality of external threads formed thereon and extending toward a lower end of said ring, said lower region of said ring being adapted to be threadedly engaged with said rubber seal whereby, upon rotation of said ring with respect to said rubber seal, said rubber seal is expanded radially into forcible engagement with said sewer pipe, and said central aperture is defined at least in part by a first cone shaped portion tapering inwardly from said upper planar surface toward said lower region and a second cone shaped portion extending from said lower end of said ring upwardly toward said first cone shaped portion of said central aperture and tapering outwardly from said lower end of said ring toward said first cone shaped portion of said central aperture.

2. The toilet sealing ring adapter assembly set forth in claim 1 wherein:

the angle of taper of said second cone shaped portion of said central aperture is different from the angle of taper of said first cone shaped portion of said central aperture.

3. The toilet sealing ring adapter assembly set forth in claim 1 wherein:

said first and second cone shaped portions of said central aperture intersect directly.

4. The toilet sealing ring adapter assembly set forth in claim 1 wherein:

said rubber seal includes a generally cylindrical lip projecting radially outwardly from said outer surface of said rubber seal for engagement with an upper peripheral edge of said sewer pipe.

5. A toilet sealing ring adapter assembly for use in forming a connection to a sewer pipe, said sewer pipe having a generally horizontally oriented open mouth at an upper periphery of said sewer pipe, said sealing ring adapter assembly comprising:

a rubber seal formed in a generally cylindrical configuration with a generally central passage having an interior surface provided with a plurality of internal screw threads on said interior surface, said seal having a smooth, generally cylindrical outer surface, said seal being adapted to be positioned within said sewer pipe and resiliently deformable into engagement with an inner wall surface of said sewer pipe; and a toilet ring fabricated of one of metal and plastic in a generally cylindrical configuration and including a central aperture extending therethrough, said ring including an upper region and a lower region, said upper region including a generally circular ledge having an upper transverse generally planar surface, said central aperture opening to said upper planar surface and defined by a first cone shaped portion tapering inwardly from said upper planar surface toward said lower region for conducting fluid flow toward a second cone shaped portion of said central aperture, said second cone shaped portion tapering inwardly toward a lower end of said ring, a plurality of elongated closet bolt receiving apertures formed in said ledge circumferentially spaced apart about said central aperture and a plurality of circumferentially spaced apart holes formed in said ledge, said lower region of said ring being formed to have a generally cone shaped externally threaded portion including a plurality of external threads formed thereon and extending from said lower end of said ring toward said ledge, and a generally cylindrical portion extending between said threaded portion and said ledge, the longitudinal extent of said cylindrical portion being less than said threaded portion, said lower region of said ring being adapted to be threadedly engaged with said seal whereby, upon rotation of said ring with respect to said seal, said seal is expanded radially into forcible engagement with said sewer pipe.

6. A toilet sealing ring adapter assembly for use in forming a connection to a sewer pipe, said sewer pipe having a generally horizontally oriented open mouth at an upper periphery of said sewer pipe, said sealing ring adapter assembly comprising:

a rubber seal formed in a generally cylindrical configuration with a generally central passage having an interior surface provided with a plurality of internal screw threads on said interior surface, said seal having a smooth, generally cylindrical outer surface, said seal being adapted to be positioned within said sewer pipe and resiliently deformable into engagement with an inner wall surface of said sewer pipe; and a toilet ring fabricated of one of metal and plastic in a generally cylindrical configuration and including a central aperture extending therethrough, said ring including an upper region and a lower region, said upper region including a generally circular ledge having an upper transverse generally planar surface, said central aperture opening to said upper planar surface and defined by a first cone shaped portion tapering inwardly from said upper planar surface toward said lower region for conducting fluid flow to a second cone shaped portion of said central aperture, said second cone shaped portion tapering inwardly toward a lower end of said ring, a plurality of elongated closely bolt receiving apertures formed in said ledge circumferentially spaced apart about said central aperture and a plurality of circumferentially spaced apart holes formed in said ledge, said lower region of said ring being formed to have a generally cone shaped externally threaded portion including a plurality of external threads formed thereon and extending from said lower end of said ring toward said ledge, and a generally cylindrical portion extending between said threaded portion and said ledge, the longitudinal extent of said cylindrical portion being one of substantially equal to and greater than said threaded portion, said lower region of said ring being adapted to be threadedly engaged with said seal whereby, upon rotation of said ring with respect to said seal, said seal is expanded radially into forcible engagement with said sewer pipe.

* * * * *